United States Patent [19]

Remington et al.

[11] 4,366,686

[45] Jan. 4, 1983

[54] LATCHING SYSTEMS PARTICULARLY FOR ARTICLES OF LUGGAGE

[75] Inventors: Richard C. Remington, Pompton Plains; Lazlo Bako, Woodcliff Lake, both of N.J.

[73] Assignee: Presto Lock, Inc., Garfield, N.J.

[21] Appl. No.: 179,832

[22] Filed: Aug. 20, 1980

[51] Int. Cl.[3] ..... E05B 37/02

[52] U.S. Cl. ..... 70/71; 70/312

[58] Field of Search ..... 70/312, 67, 69, 70, 70/71, 73, 76, 288

[56] References Cited

U.S. PATENT DOCUMENTS

| | | | |
|---|---|---|---|
| 3,439,515 | 4/1969 | Gehrie | 70/288 |
| 3,545,238 | 12/1970 | Gehrie | 70/312 |
| 3,555,860 | 1/1971 | Atkinson | 70/312 |
| 3,584,906 | 6/1971 | Passaic | 292/247 |
| 3,695,072 | 10/1972 | Milette | 70/312 |
| 3,961,505 | 6/1976 | Gehrie et al. | 70/66 |
| 4,123,923 | 11/1978 | Bako | 70/74 |

FOREIGN PATENT DOCUMENTS 1338360 11/1973 United Kingdom .

*Primary Examiner*—Robert L. Wolfe

*Attorney, Agent, or Firm*—Shapiro and Shapiro

[57] ABSTRACT

A latching system particularly for a latching console used on a luggage article to releasably secure a body section of the article to a hinged lid, includes a pivotal latch assembly conveniently incorporated in the handle structure of the luggage article. The latch assembly includes a dial and sleeve type combination lock so that the latch assembly can only be operated when the lock is "on combination." The latch assembly is linked to a rod extending lengthwise of the console and having sliding latch members at its opposite ends which cooperate with complementary hasp formations on the respective sections of the luggage article. Pivotal movement of the latch assembly is thereby accompanied by longitudinal movement of the rod to operate the sliding latch members. The hasp formations may be in the form of ribs integrally formed with the respective sections of the luggage article.

14 Claims, 18 Drawing Figures

FIG. 11a.
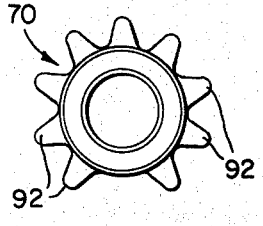
FIG. 13a.
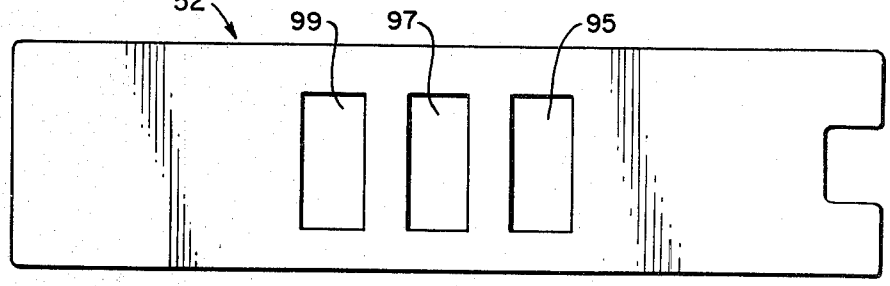
FIG. 11b.
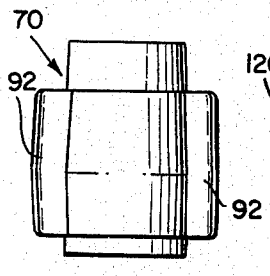
FIG. 13b.
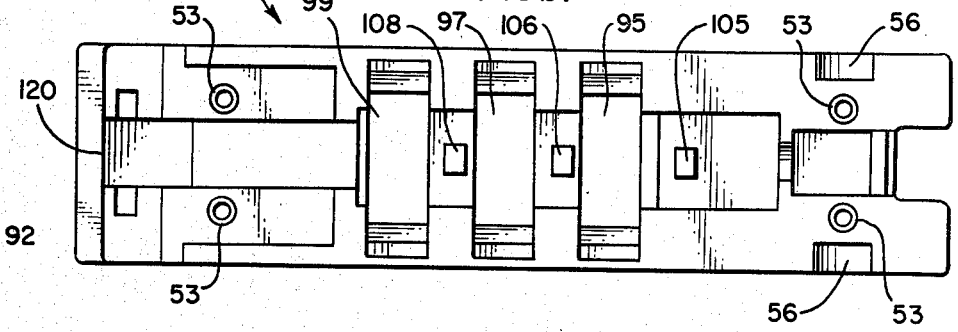
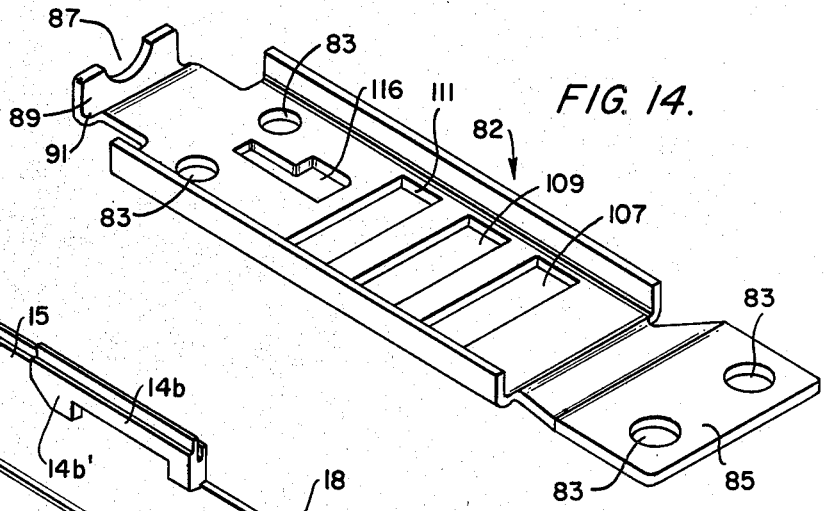
FIG. 14.
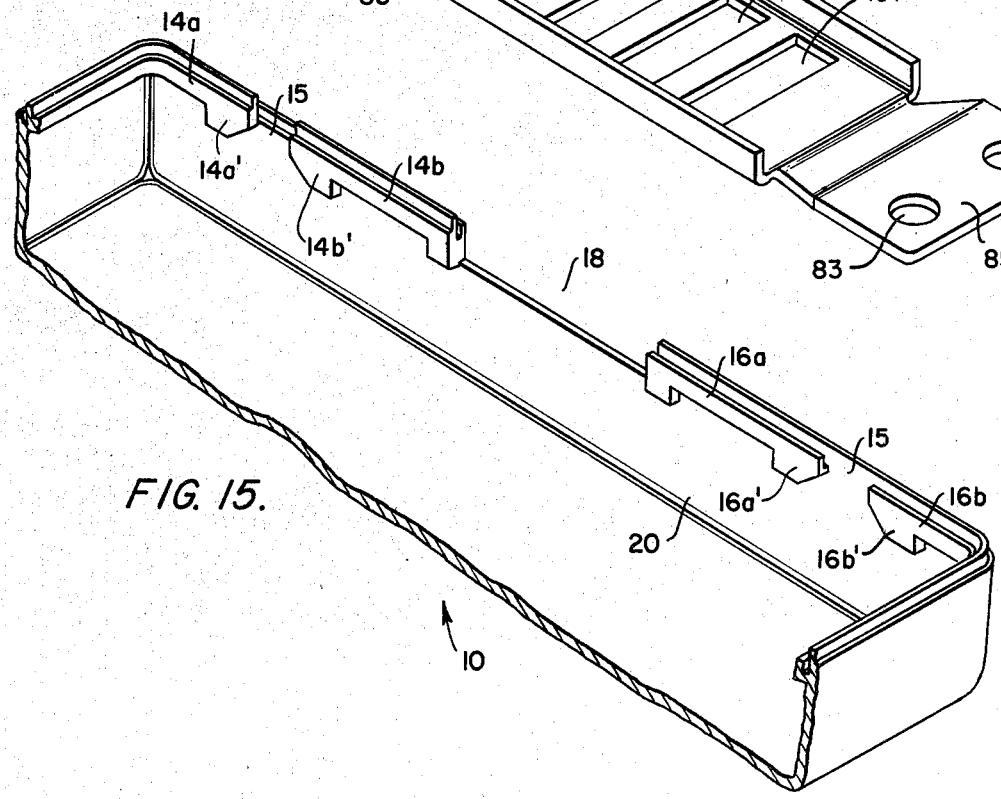
FIG. 15.

LATCHING SYSTEMS PARTICULARLY FOR ARTICLES OF LUGGAGE

BACKGROUND OF THE INVENTION

This invention relates to latching systems, particularly for use on receptacles such as articles of luggage which include sections to be releasably secured together, for example, a body section and a hinged lid.

For luggage articles such as attache and like cases, it is well known to produce the body and lid sections in the form of molded shells of synthetic materials and to provide a latching means for releasably securing the sections together in the form of a console arrangement attached to a front wall of one of the case sections, usually the body section. The console may for example include a central handle-mounting structure, a latch mechanism on each side of the handle structure, for cooperation with complementary hasps or the like on the other case section, and some form of operating means and locking means for the latch mechanisms. One form of console arrangement is shown, for example, in U.S. Pat. No. 3,961,505, issued June 8, 1976 to Gehrie et al, and commonly assigned herewith.

An object of the present invention is to provide a novel form of latching system suitable for use in a latching console for a luggage article. More particularly, it is an object of the invention to provide a latching system of this type, which includes a central pivotal latch assembly, preferably incorporating a combination lock, which assembly is used to operate a pair of latch devices on opposite sides thereof, the latch devices being adapted to releasably secure the respective sections of the luggage article together.

A further object of the invention is to provide a novel form of pivotal latch assembly incorporating a combination lock.

Another object of the invention is to provide a pivotal latch assembly including a body member, an elongated latch member adapted to be moved longitudinally in the body member from a latching to an unlatching position, by means of a puller, and a dial and sleeve type combination lock associated with the latch member to permit longitudinal movement therof only when the lock is "on-combination."

Still another object of the invention is to provide a luggage case of the molded shell type and a latching console for use therewith, wherein the respective case sections have integrally molded internal formations on the respective front wall portions thereof, which formations are releasably gripped by sliding latch members of the console to releasably secure the sections together.

Yet another object of the invention is to provide a molded shell type luggage case having substantially identical and interchangeable body and lid sections and a latching console which can be mounted in either of such sections in a reversible manner.

A further object of the invention is to provide a luggage case which provides economies in manufacture by duplication of the respective case sections.

SUMMARY OF THE INVENTION

With the above objects in view, the present invention provides a latching system based on a pivotal latch assembly comprising a body member attached to a housing structure for pivotal raising and lowering movements and a longitudinally movable latch member associated with the body member for cooperation with a fixed hasp on the housing structure, the latch member having a latching section projecting from one end of the body member and a puller at the other end of the body member, for moving the latch member between latching and unlatching positions with respect to the hasp. The latching member may conveniently be in the form of a shaft carrying sleeves and dials of a combination-type lock, with the dials being accessible for operation, through suitable openings in the body member, so that the puller can only effect longitudinal movement of the latching member from the latched to the unlatched position, when the dials of the combination lock are "on combination." The latch member, in accordance with another aspect of the invention, has a lost-motion connection with the puller, allowing independent movement of the latch member for changing the lock's combination.

As applied to a console-type latching system for attachment to the front wall of one section of a luggage article, the pivotal latch assembly as described in the preceding paragraph, may be incorporated in the central handle structure of the article with its latch member engaging a hasp surface on the handle structure and the latch assembly may be associated with an underlying laterally movable rod, the opposite ends of which form sliding latches adapted to slide into and out of engagement with receiving ribs and the like formed on the respective sections of the luggage article, for releasably connecting and disconnecting the sections when the pivotal assembly is raised and lowered. Conveniently with this arrangement, the rod may be spring biased to urge the latch assembly outwardly from the plane of the console, through a longitudinally moving and swiveling link, when the latch member is released by the puller. This movement thereby releases the sliding latches at opposite ends of the rod from engagement with their respective receiving ribs, to allow opening of the article.

A molded shell type case suitable for fitment with a latching system as described above, may conveniently have integrally molded formations on the respective sections, forming the above-referred to ribs and the like for receiving the sliding latches. Further, the respective sections may be identical moldings thereby economizing on manufacturing costs.

The invention will be described by way of an example with reference to the accompanying drawings.

BRIEF DESCRIPTION OF THE DRAWINGS

FIGS. 11*a* and 11*b* are an end view and a plan view respectively of a combination lock sleeve;

FIGS. 13*a* and 13*b* are a top plan view and a bottom plan view respectively of a body member of the latch assembly;

FIG. 14 is a perspective view of a frame used in the latch assembly;

FIG. 15 is a perspective view of the front part of the body section of the case shown in FIG. 1, prior to attachment of the console latching system.

DESCRIPTION OF PREFERRED EMBODIMENT

Figure 1:
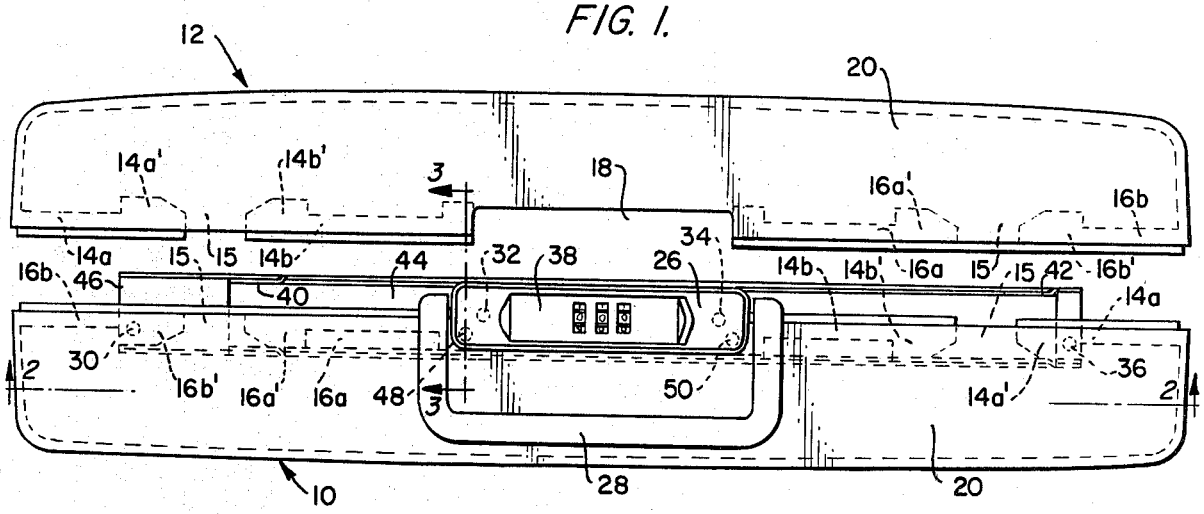
FIG. 1 is a front elevation showing the separate body and lid sections of a molded shell attache or like case, having a console-type latching system on the front wall of the body section.

As shown particularly in FIGS. 1, 2, 3 and 15, an attache or like case, constructed in accordance with a preferred form of the invention, comprises a pair of identical shells molded from conventional synthetic materials, one of such shells constituting a body section 10 of the case and the other shell constituting a hinged lid section 12.

Each of sections 10 and 12 has a front wall 20, formed with a cut-out 18 centralized with respect to the vertical center line of the respective wall and integral moldings 14*a*, 14*b* and 16*a*, 16*b* on opposite sides of the cut-out, such moldings defining the valances of the respective sections. Further, the profiles of moldings 14*a* and 14*b* are complementary to the profiles of moldings 16*a* and 16*b* (see FIGS. 3 and 15) so that the two sections are interchangeable and fit properly together. Additionally, openings 15 are formed between molding sections 14*a* and 14*b* and between molding sections 16*a* and 16*b*, the openings being bounded by head portions 14*a*', 14*b*', 16*a*' and 16*b*' of the respective moldings, which head portions define latch formations, as will be described.

One of the sections 10 and 12, in this case, body section 10, is provided with a latching console attached to its front wall 20 by fasteners such as screws, rivets or the like, indicated by reference numerals 30, 32, 34, 36. The latching console includes a handle structure 26 fitting in opening 18 of the body section and to which is attached a conventional pivotal handle 28, a central latch assembly 38 associated with the handle structure, the handle structure forming a housing structure for the latch assembly, an elongated channel shaped base plate 46 and an elongated longitudinally movable rod 44, operated in conjunction with the latch assembly to latch or unlatch the case sections by means of sliding latches 40, 42 at opposite ends of the rod (see FIGS. 1, 2, 3 and 4). Handle 28 is attached to handle structure 26 by conventional handle wires 29 (only one being shown in the drawings), which are inserted in openings 31 at opposite ends of the handle structure and held in place by washers 33 (see FIGS. 5 and 6).

Base plate 46 is attached from behind to front wall 20 of body section 10, by fasteners 30, 36 and handle structure 26 is secured to the base plate by fasteners 32, 34, and is further secured to front wall 20 by additional fasteners 48, 50.

Figure 2:
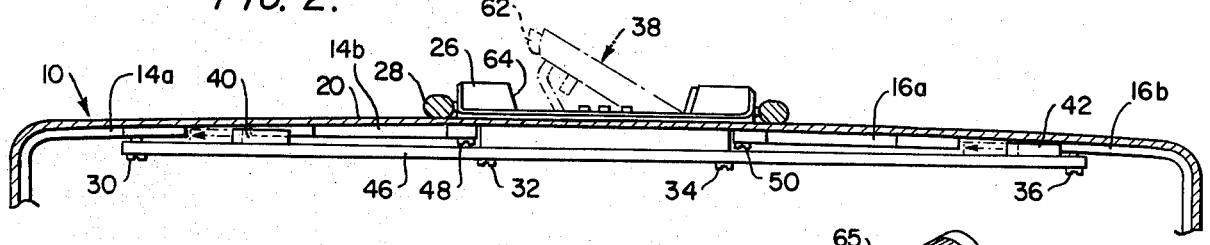
FIG. 2 is a sectional view of the front wall portion of the body section of a case, on line 2—2 of FIG. 1, and showing in phantom a central pivotal latch assembly in a raised position.
Figure 3:
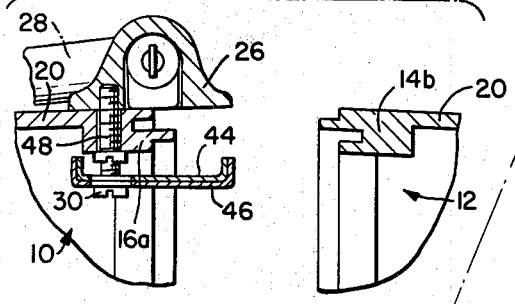
FIG. 3 is a sectional view of a part of the case on line 3—3 of FIG. 1.
Figure 4:
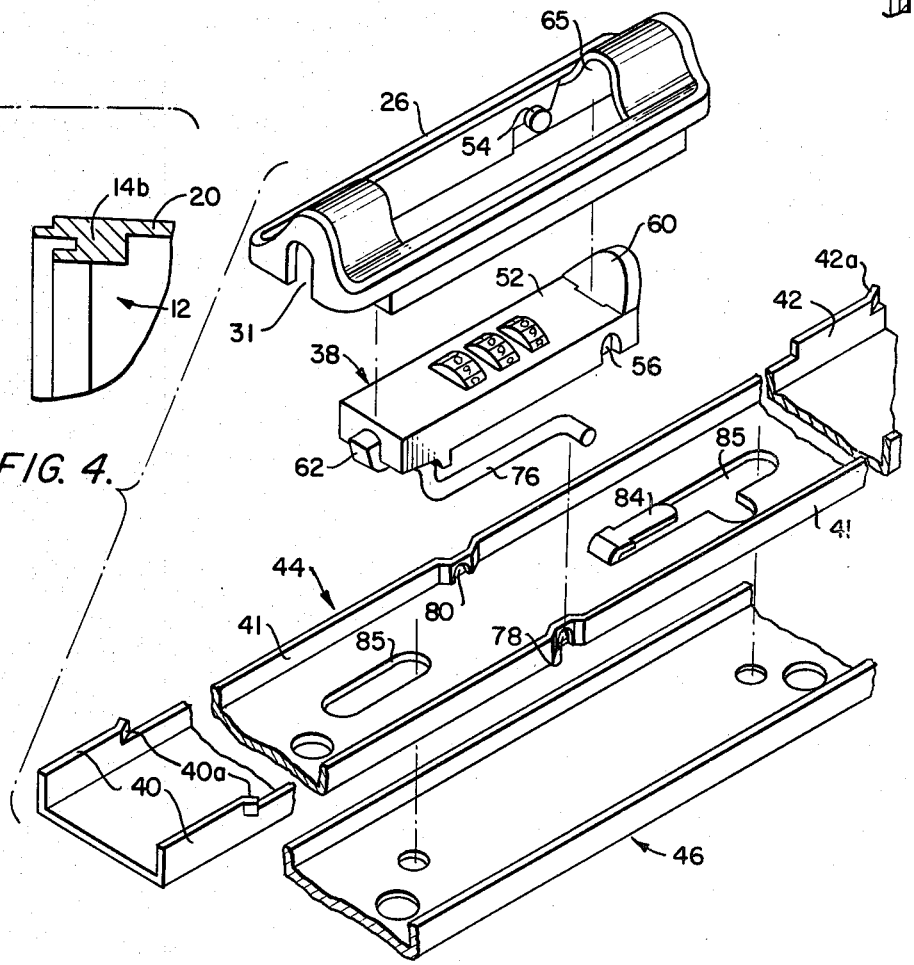
FIG. 4 is a perspective exploded view of parts of the latching assembly.

As shown in FIG. 4, latches 40, 42 are formed as raised extensions of central wall sections 41 of rod 44 and the latches have flared lead-in portions 40*a* and 42*a*. Rod 44 is longitudinally movable in base plate 46 under the control of latch assembly 38 in a manner to be described, between an unlatched position, in which latches 40 and 42 are located in the aligned openings 15 in case sections 10 and 12, respectively, and a latched position in which latches 40 and 42 grip the right-hand set of head portions of the respective moldings 14 and 16. Notably, latch 42 grips head portion 14*a*' of case section 10 and head portion 16*b*' of case section 12 therebetween while latch 40 grips head portion 16*a*' of case section 10 and head portion 14*b*' of case section 12 therebetween. In the unlatched position with latches 40 and 42 located in openings 15, the wall sections 41 of rod 44 clear the respective head portions of the moldings 14 and 16 allowing the case to be opened and closed. As will be described, when the case is closed, latch assembly 38 can be pressed down (FIG. 2) to move rod 44 to the right so that latches 40, 42 move from the openings 15 into gripping engagement with the above-noted right-hand set of head portions. Conversely, when latch assembly 38 is released for upward movement, latches 40, 42 move to the left into openings 15. Alternatively, the console can be reversely mounted on the opposite hand in case section 10, so that rod 44 moves to the left as shown in FIGS. 1 and 2 when latch assembly 38 is depressed and vice versa, using the left-hand set of head portions 14*a*', 14*b*', 16*a*', 16*b*' (as shown in FIGS. 1 and 2) to cooperate with latches 42 and 40, rather than the right-hand set as above described. The illustrated case, can thus be constructed with either section 10 or 12 as the body section or hinged lid, the latching console being mounted in either section with equal facility, and furthermore, the console can be mounted for either left or right hand operation.

The construction of latch assembly 38 and its connection with rod 44 will now be described. Latch assembly 38 (see particularly FIGS. 4, 5 and 6) comprises a body member 52 pivotally mounted in the handle structure by opposed projections 54 in the handle structure, which fit in complementary recesses 56 in the body member 52, a latch member in the form of a shaft 58 carried within the body member 52, a manual actuator means comprising a puller 60 connected to one end of latch member 58, and a base member 82. The other end of latch member 58 is formed as a latching section 62, cooperating with a wall 64 of the handle structure 26, which forms a hasp for the latch. Puller 60 is accommodated in a recess 65 in the handle structure 26, where it can be readily operated by thumb or finger pressure. The construction of the latch assembly is therefore such that body member 52 can be pivoted about projections 54 toward and away from a plane defining the bottom edge of hasp wall 64.

Figure 9:
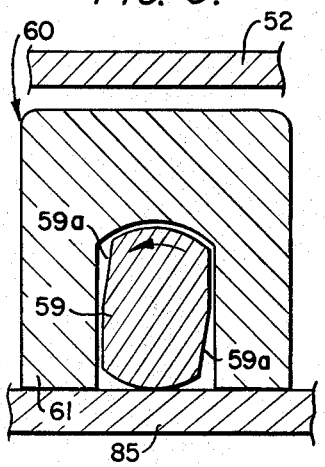
FIG. 9 is a sectional elevation of a part of the latch assembly on line 9—9 of FIG. 6.

The connection between puller 60 and latch member 58 comprises a forked front portion 61 of the puller which fits over a flattened section 59 of latch member 58 (see FIGS. 5, 6, 9 and 16) so that the puller works against a shoulder on the latch member defined by the right end of the flattened section with a similar shoulder formed at the other end of the flattened section. It will be noted that flattened section 59 thus forms a lost-motion connection between the puller and latch member 58, causing the latch member to move with the puller when the puller is drawn to the right but allowing the latch member to be moved to the right relative to the puller. Further, as seen in FIG. 9, the flattened section 59 has beveled portions 59*a*, allowing limited tilting movement of latch member 58 in the puller as will be described later.

Figure 6:
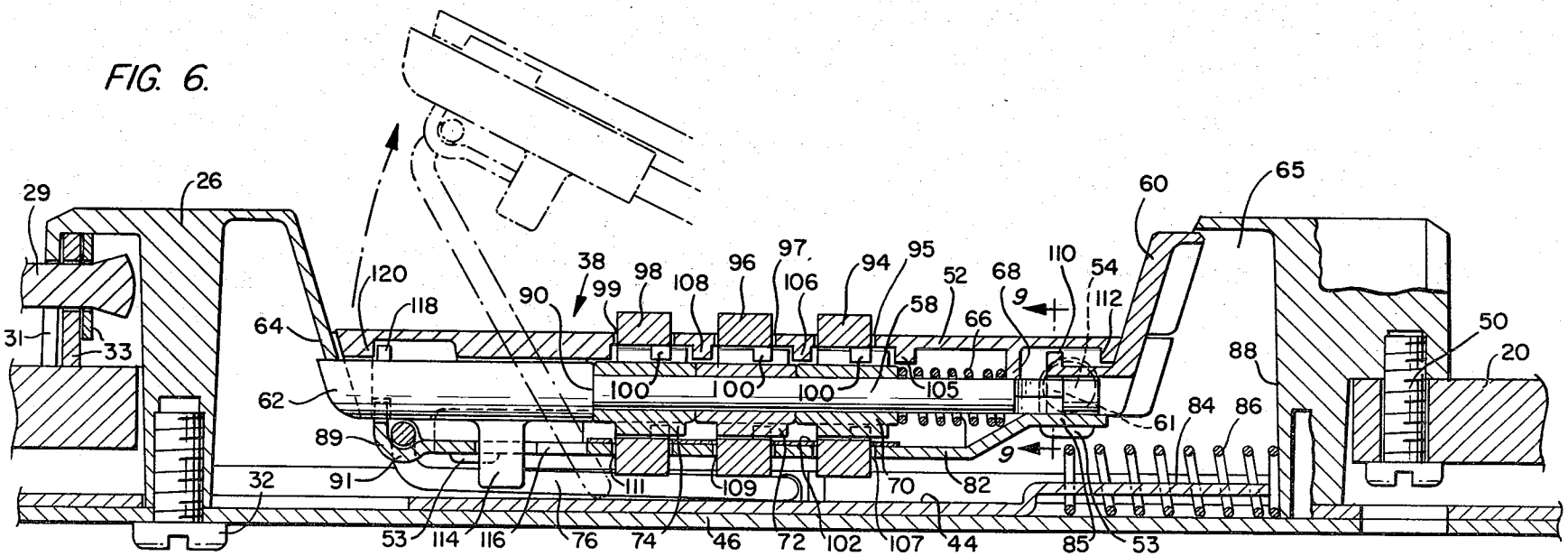
FIG. 6 is a sectional elevation of the latch assembly on line 6—6 of FIG. 5.
Figure 7:
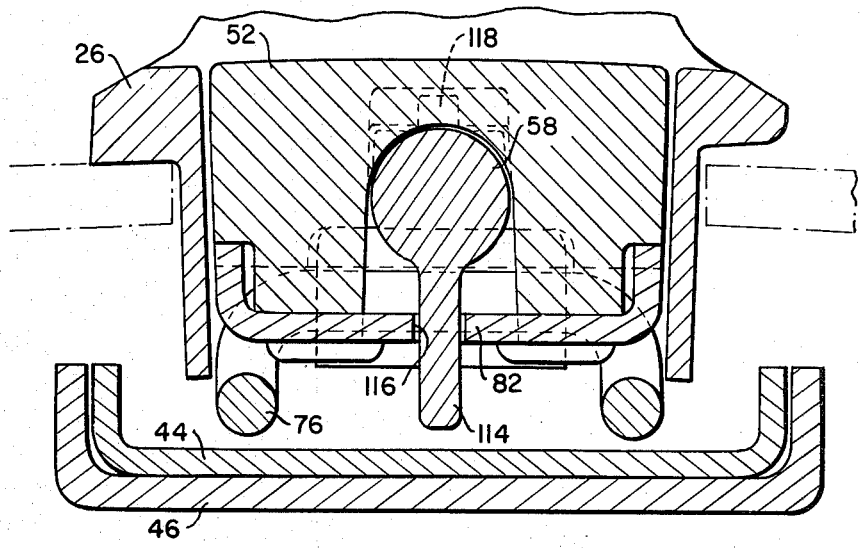
FIG. 7 is a sectional elevation of the latch assembly on line 7—7 of FIG. 5.

Shaft 58 is accommodated for longitudinal movement between body member 52 and base member 82. Members 52 and 82 are attached together, for example, by rivets 53, integrally formed on the body member (FIG. 13*b*) and which mate with openings 83 in the base member (FIG. 14), the rivets being suitably headed over as shown in FIG. 6. The rear end of shaft 58 and the puller 60 are supported on a rear surface 85 of base member 82 while the forward end of shaft 58 is supported in a cut-out 87 in an upturned front wall 89 of the base member.

Latch member 58 is biased to a latch engaging position (i.e., biased to the left as shown in the drawings) by a first compression spring 66 embracing a portion of the latch member and reacting between a wall surface 68 of body member 52 on the one hand, and sleeve 70 on the other hand, carried by latch member 58 (Sleeve 70 forms one of the sleeves 70, 72, 74 of a combination lock, to be described, which is associated with the latch assembly.) Sleeve 74 engages a shoulder 90 of the latch member 58, so that the force of spring 66 urges the latch member to the left. A lug 118 on latch member 58 limits its movement to the left by engaging a shoulder 120 on body member 52. In this position of the latch member and puller, the puller engages a shoulder 112 formed on body member 52 to prevent the puller from moving to the left relative to latch member 58.

With the above-described arrangement, release of the latch assembly from the latched condition shown in full line in FIG. 6 is accomplished, when the combination lock is "on combination" as will be described, by moving puller 60 and thereby the latch member 58 to the right, against the pressure of spring 66, releasing latching section 62 of latch member 58 from wall 64 and allowing the latch to be pivotally raised to its open position, shown in phantom line.

Figure 5:
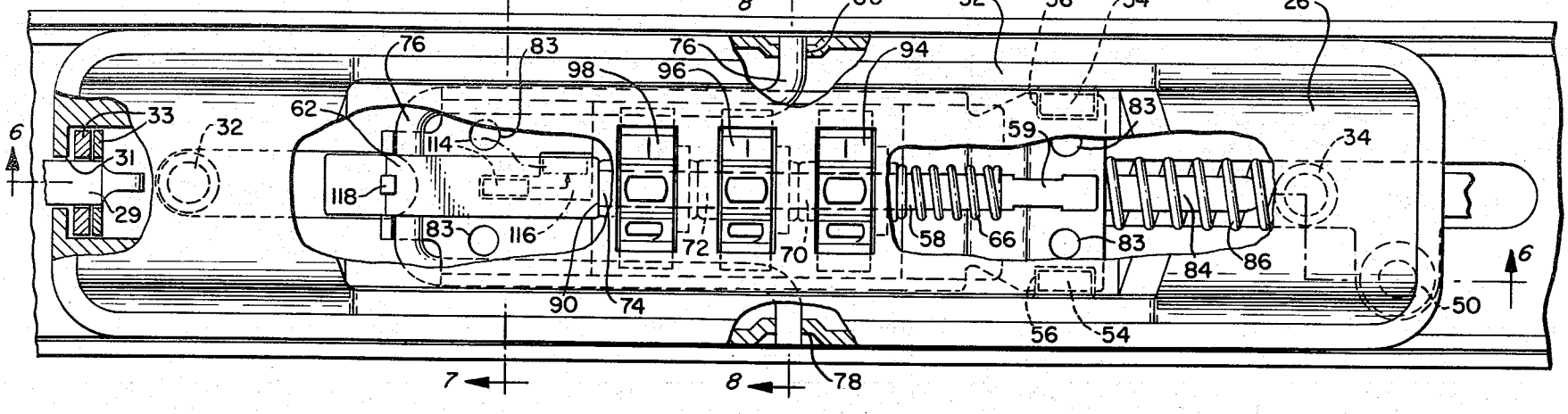
FIG. 5 is a plan view, with parts broken away, showing details of the latch assembly.

To provide longitudinal movement of rod 44 in conjunction with pivotal movements of latch assembly 38, the rod is connected to the latch assembly by means of a bifurcated, substantially U-shaped link 76, the opposite ends of which are turned out and received in opening 78, 80 in the rod, with the cross member of link 76 being received in a recess 91 at the forward end of base member 82. Further, rod 44 includes a central tongue 84, which receives a second compression spring 86, which urges the rod to the left as seen in FIGS. 5 and 6, by reacting against a wall 88 of the handle structure (see FIG. 6). Rod 44 further includes elongate openings 85 (FIG. 4) which accommodate fasteners 32 and 34 while permitting longitudinal movement of the rod.

With the latch assembly 38 in the latched condition, shown in full line in FIGS. 5 and 6, rod 44 is in a right-hand position with spring 86 compressed, and sliding latches 40, 42 are in engagement with the head portions of the respective moldings 14 and 16 as previously described, so that the case is latched in a closed condition. Then, to open the case, if the combination lock is "on combination" puller 60 is depressed into cavity 65 to move the latch member 58 to the right and release the latch assembly. This operation relieves the pressure on spring 86 and rod 44 moves to the left under the action of spring 86, whereby latch assembly 38 is urged upwardly by right to left longitudinal movement and upward pivotal movement of link 76. Also, longitudinal movement of the left of rod 44 causes sliding latches 40, 42 to move out of engagement with the previously described head sections of moldings 14 and 16 and into openings 15 so that the case can be opened.

Conversely, to latch the case, when it is closed, downward movement of latch assembly 38 effects left to right movement of rod 44, through link 76, compressing spring 86 and moving latches 40, 42 back into engagement over the respective head sections of moldings 14 and 16. The latched condition of the case sections is maintained when latch member 58 snaps into engagement under wall 64 (by compression of spring 66), thereby retaining rod 44 in its righ-hand position against the biasing action of spring 86.

To secure the case against undesired opening, the combination lock, previously referred to, is incorporated in latch assembly 38, to prevent the latch member 58 from being moved by the puller, from its latched to its unlatched position, unless the lock is "on combination."

Figure 8:
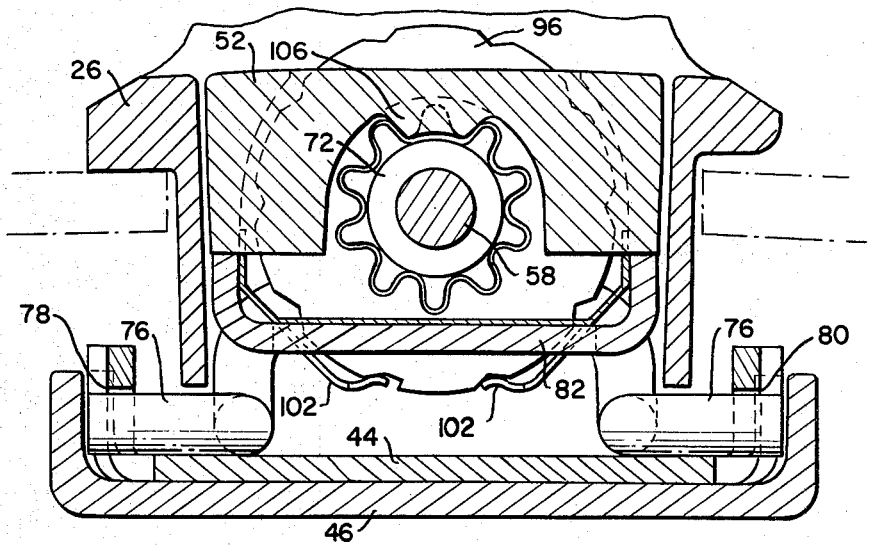
FIG. 8 is a sectional elevation of the latch assembly on line 8—8 of FIG. 5.
Figure 10:
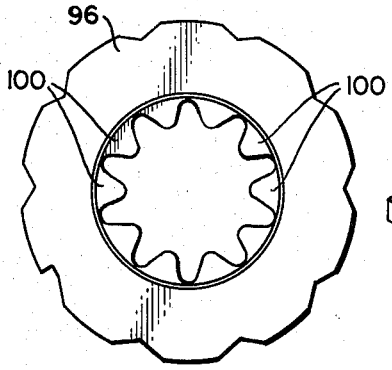
FIG. 10 is an end view of a combination lock dial used in the latch assembly.
Figure 12:
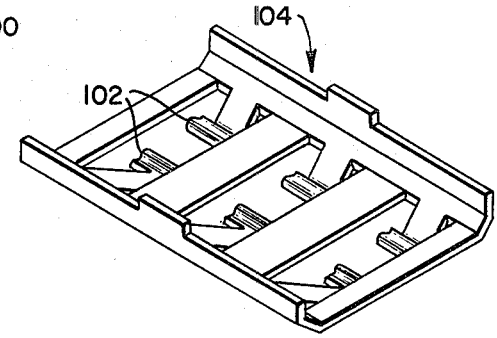
FIG. 12 is a perspective view of a dial spring for the combination lock.
Figure 16:
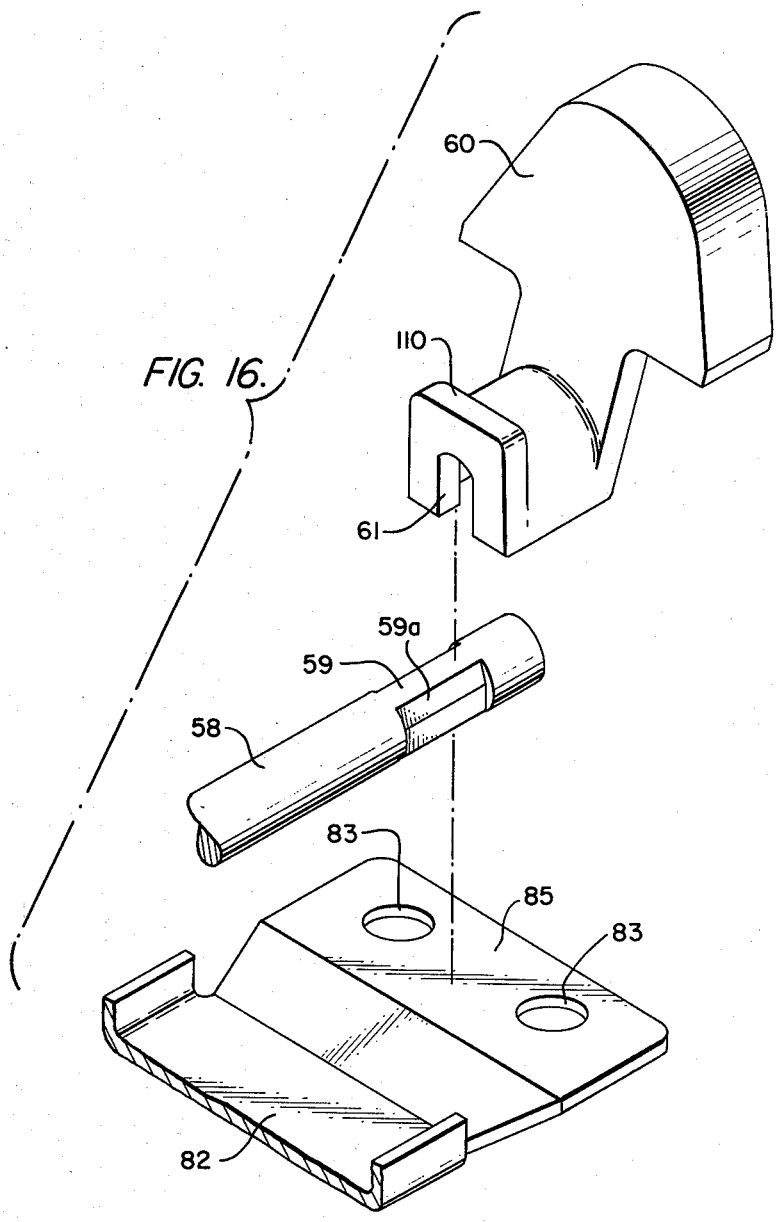
FIG. 16 is an exploded perspective view showing parts of the latching assembly.

The combination lock includes a first set of combination locking elements in the form of the previously referred to sleeves 70, 72 and 74 carried on the latch member 58 between spring 66 and shoulder 90 on the latch member, so that the sleeves are caused to move longitudinally in unison with the latch member, while being free to rotate thereon. Each of the sleeves is formed with evenly spaced peripheral teeth 92 (see FIG. 11*a*) with one tooth on each sleeve being omitted. Sleeves 70–72 carry conventional combination lock dials 94, 95, 98 forming a complementary sets of combination locking elements and which, as shown in FIGS. 6, 8 and 10, each have a full complement of internal teeth 100, meshing with teeth 92 of the sleeves. The teeth 100, as seen in FIG. 6, extend only for a portion of the width of each dial. Externally, each dial is provided in known manner, with a circumferential series of numerals and recesses therebetween which engage with arms 102 of a dial spring 104 (FIG. 12), carried on base member 82, to provide positive step-by-step rotation of each dial, for moving the dials from numeral to numeral. A portion of each dial projects outwardly from the body member 52 through openings 95, 97, 99 in the body member, for manipulation of the respective dials and peripheral portions of the dials also project through aligned openings 107, 109, 111 in base member 82. Further, body member 52 has downwardly projecting blocking formations 105, 106, 108 disposed between the respective dials, such formations (see FIG. 8) conforming in shape and location with the space defined between adjacent teeth of the respective sleeves bounding the omitted tooth.

With the above described arrangement, the dials and the associated sleeves can be rotated step-by-step about latch member 8, to move the lock between its "on combination" and "off combination" settings. In the "on combination" setting of the dials, the space defined by the omitted tooth of each of the sleeves 70–74 aligns with the blocking formations 105–108, allowing the puller 60 to move latch member 58, along with sleeves 70–74 to the right, thereby unlatching the assembly. In all other settings of the dials, a tooth 92 on at least one of the sleeves 70–72 will align with one of the blocking formations 105–108 so that the latch member is effectively blocked and cannot be moved to the right to unlatch the assembly.

Movement of the latch member 58 to the right, during the above described unlatching operation, is limited by a projection 110 on the puller (see FIG. 6), which engages shoulder 112 of body member 52. In the extreme position, the sleeve teeth 92 remain in engagement with dial teeth 100. Also, in this position, since blocking formations 105, 106, 108 are present in the omitted tooth spaces of the respective sleeves, the dials and sleeves cannot be rotated on shaft 58.

The combination lock also includes means for changing the combination. To effect a combination change it is necessary to move teeth 92 of sleeves 70–74 out of mesh with teeth 100 of dials 94–98, so that the dials can be rotated relative to the sleeves. This is accomplished by moving latch member 58, along with sleeves 70–74 further to the right than with the movement obtained in an unlatching operation. To this end, latch member 58 includes a downwardly extending lug 114 projecting through an L-shaped opening 116 in base member 82, the tip on the lug being accessible when the latch assembly is in the opened position.

To change the combination, the lock must be on-combination and latch member 58 is then moved to the right independently of puller 60 by means of lug 114, carrying with it sleeves 70–74. The lengths of opening 116 and flattened shaft section 59 are sufficient to allow the sleeves and dials to be brought out of mesh. When lug 114 reaches the end of its travel in opening 116, the shaft can be tilted relative to the puller due to beveled portions **59*a*, so that the lug 114 can be moved into the transverse limb of opening 116 (see FIG. 5) to hold the lock in the combination changing position. The new combination is set when the latch member 58 is tilted back to its initial position and sleeve teeth 92 are brought back into mesh with the dial teeth 100, by movement of the latch member 58 to the left and release of the lug 114**.

It will be seen from the foregoing that the invention provides a pivotal or lift-up type latch assembly which includes a convenient form of combination lock and which can advantageously be incorporated in the handle structure of a luggage article, to provide a console-type of latching arrangement including, ine one preferred form, a link connection with a moving rod which carries sliding latches at its opposite ends for releasably securing respective sections of the luggage article together.

While only a single preferred embodiment of the invention has been described herein in detail, the invention is not limited to the specific features thereof and modifications can be made within the scope of the appended claims. For example, alternative forms of combination locks to that specifically described, may be used in the pivotal latch assembly.

We claim:

1. A latching arrangement comprising a housing structure and a latch assembly mounted for pivotal movement on said housing structure toward and away from a hasp associated with said housing structure, said latch assembly including a body member, latch means mounted for movement in said body member between latching and unlatching positions with respect to said hasp, actuator means associated with said latch means for manually moving said latch means in said body member from said latching position to said unlatching position and combination locking means comprising a plurality of individually movable locking devices for permitting manual movement of said latch means by said actuating means only when said locking devices are on-combination, wherein said latch means includes an elongated latch member mounted for longitudinal movement in said body member and wherein each of said locking devices comprises a sleeve carried by said latch member for longitudinal movement therewith and a dial surrounding said sleeve, each of said sleeves and its surrounding dial being rotatable in unison about said latch member and wherein said body member includes blocking means allowing longitudinal movement of said latch member and said sleeves relative to said dials to move said latch member from said latching to said unlatching position only when said sleeves and dials are on-combination.

2. The latching arrangement as defined in claim 1, including means for changing the combination of said locking means by moving said sleeves out of mesh with the respective dials through longitudinal movement of said latch member.

3. The latching arrangement as defined in claim 1, wherein said body member is mounted on said housing structure for pivotal movement toward and away from a plane defining said hasp.

4. The latching arrangement as defined in claim 1, including means biasing said latch means toward said latching position.

5. A latching arrangement comprising a housing structure and a latch assembly mounted for pivotal movement on said housing structure toward and away from a hasp associated with said housing structure, said latch assembly including a body member, latch means mounted for movement in said body member between latching and unlatching positions with respect to said hasp, actuator means associated with said latch means for manually moving said latch means in said body member from said latching position to said unlatching position and combination locking means comprising a plurality of individually moveable locking devices for permitting manual movement of said latch means by said actuating means only when said locking devices are on-combination, wherein the arrangement further includes a longitudinally moveable elongated rod disposed substantially in parallel with said body member when said latching assembly is in said latched position with respect to said housing structure, a base means supporting said rod, means defining a sliding latch at least on one end section of said rod and link means connected between said latch assembly and said rod for effecting longitudinal movement of said rod in conjunction with pivotal movement of said latch assembly.

6. The latching arrangement as defined in claim 5, including biasing means connected between said housing structure and said rod for urging said rod in a direction tending to move said latch assembly out of parallel with said rod through said link means.

7. A latching console for use on a receptacle such as a luggage article, said console comprising an elongated substantially planar base plate means, a housing structure, means for attaching said base plate means and said housing structure to a wall of one section of a receptacle with said base plate means extending along an inner surface of said wall and said housing structure being located on an outer surface of said wall, a rod mounted for lengthwise movement along said base plate means, means defining a sliding latch member at least on one end portion of said rod, a latch assembly mounted on said housing structure for pivotal movement toward and away from a plane containing said base plate means, said latch assembly including a body member pivotally mounted on said housing structure, latch means mounted in said body member for movement into and out of engagement with a hasp on said housing structure, actuator means associated with said latch means for moving said latch means from a latching position to an unlatching position with respect to said hasp to permit pivoting movement of said latch assembly, and link means connecting said latch assembly with said rod for effecting lengthwise movement of said rod in conjunction with pivotal movements of said latch assembly.

8. The latching console as defined in claim 7, including combination locking means comprising a plurality of individually adjustable locking devices for permitting movement of said latch means relative to said body member from said latching position to said unlatching position only when said locking devices are on-combination.

9. The latching console as defined in claim 8, including biasing means connected between said housing structure and said rod for urging said rod in a direction tending to pivot said body member away from said rod through said link means.

10. The latching console as defined in claim 8, wherein said latch means includes an elongated member mounted for longitudinal movement in said body member and wherein each of said locking devices comprises a combination dial and sleeve mounted on said elongated member, said body member including blocking means for inhibiting longitudinal movement of said elongated member and sleeves relative to said dials except when the locking devices are on-combination.

11. A combination lock including a body member, a latching member in said body member movable between latching and unlatching positions when the lock is on combination, a plurality of combination lock elements which must be set in predetermined positions to place the lock on combination, said elements being carried on said latching member for movement therewith, a manual actuator for moving said latching member and combination lock elements in a latch-opening direction and connection means between said latching member and said actuator permitting movement of said latching member and combination lock elements in latch-opening direction relative to said actuator.

12. A lock as defined in claim 11, wherein said latching member comprises an elongate shaft and said connection means comprises lost-motion connection means between said actuator and said shaft providing movement of said shaft with said actuator when the actuator is moved in said latch-opening direction and allowing axial movement of said shaft relative to said actuator when the shaft is moved in said latch-opening direction independently of said actuator.

13. A lock as defined in claim 12, wherein said connection means provides for tilting movement of said shaft relative to said actuator about the longitudinal axis of the shaft.

14. A lock as defined in claim 12, wherein said combination lock elements comprise axially spaced sleeves carried on said shaft, said sleeves being coupled with encircling combination dials and wherein said connection means allows sufficient movement of said shaft relative to said actuator to uncouple said sleeves from said dials.

* * * * *